US009302408B2

(12) United States Patent
Smith

(10) Patent No.: US 9,302,408 B2
(45) Date of Patent: Apr. 5, 2016

(54) MITER BOX FENCE SYSTEM

(71) Applicant: Bernard F. Smith, Green Bay, WI (US)

(72) Inventor: Bernard F. Smith, Green Bay, WI (US)

( * ) Notice: Subject to any disclaimer, the term of this patent is extended or adjusted under 35 U.S.C. 154(b) by 111 days.

(21) Appl. No.: 13/943,763

(22) Filed: Jul. 16, 2013

(65) Prior Publication Data

US 2015/0020657 A1 Jan. 22, 2015

(51) Int. Cl.
*B27G 5/02* (2006.01)
*E04F 21/00* (2006.01)

(52) U.S. Cl.
CPC *B27G 5/026* (2013.01); *B27G 5/02* (2013.01); *E04F 21/0069* (2013.01); *Y10T 83/04* (2015.04); *Y10T 83/762* (2015.04)

(58) Field of Classification Search
CPC ..... B23D 47/104; B27B 27/08; B27G 5/02; B27G 5/026; Y10T 83/762
See application file for complete search history.

(56) References Cited

U.S. PATENT DOCUMENTS

| | | | | |
|---|---|---|---|---|
| 346,240 | A | 7/1886 | Soukup | |
| 752,406 | A | 2/1904 | Nichols | |
| 976,296 | A | 11/1910 | Robbins | |
| 3,397,722 | A | 8/1968 | Long | |
| 4,429,601 | A | 2/1984 | Taylor | |
| 4,455,904 | A * | 6/1984 | Havner et al. | 83/375 |
| 4,579,322 | A * | 4/1986 | Schwarz | 269/70 |
| 4,608,900 | A * | 9/1986 | Guiu et al. | 83/766 |
| 4,743,004 | A | 5/1988 | Kloss | |
| 4,875,399 | A | 10/1989 | Scott et al. | |
| 5,279,198 | A * | 1/1994 | Cross | 83/758 |
| 6,481,320 | B1 | 11/2002 | McGrory et al. | |
| 6,782,782 | B1 | 8/2004 | Shangle et al. | |
| 7,156,008 | B2 * | 1/2007 | Talesky | 83/468.2 |
| D557,296 | S | 12/2007 | Apodaca | |
| 7,726,224 | B1 | 6/2010 | Panko | |
| D640,112 | S | 6/2011 | Smith | |
| 2008/0250905 | A1 * | 10/2008 | Khan | 83/23 |
| 2008/0258368 | A1 * | 10/2008 | Kinnison et al. | 269/41 |

FOREIGN PATENT DOCUMENTS

| | | | |
|---|---|---|---|
| GB | 2246538 | A * | 5/1992 |
| GB | 2429426 | A * | 2/2007 |

* cited by examiner

*Primary Examiner* — Stephen Choi
(74) *Attorney, Agent, or Firm* — Martin & Associates, LLC; Derek P. Martin

(57) ABSTRACT

A miter box fence system includes a fixed vertical portion and a movable portion that may be moved with respect to the fixed vertical portion. The movable portion includes a notch that allows one edge of crown molding to be placed in the notch while the other edge of the crown molding extends towards the fixed vertical portion. The movable portion may be moved with the crown molding in place until the crown molding makes appropriate contact with the bottom of the notch and with the fixed vertical portion. The movable portion may then be secured in place. Because the notch in the movable portion creates a stop for cutting crown molding, and because the notch is below the flat portion of the movable portion, the miter box fence system may be used to cut both crown molding and flat stock without modification.

12 Claims, 5 Drawing Sheets

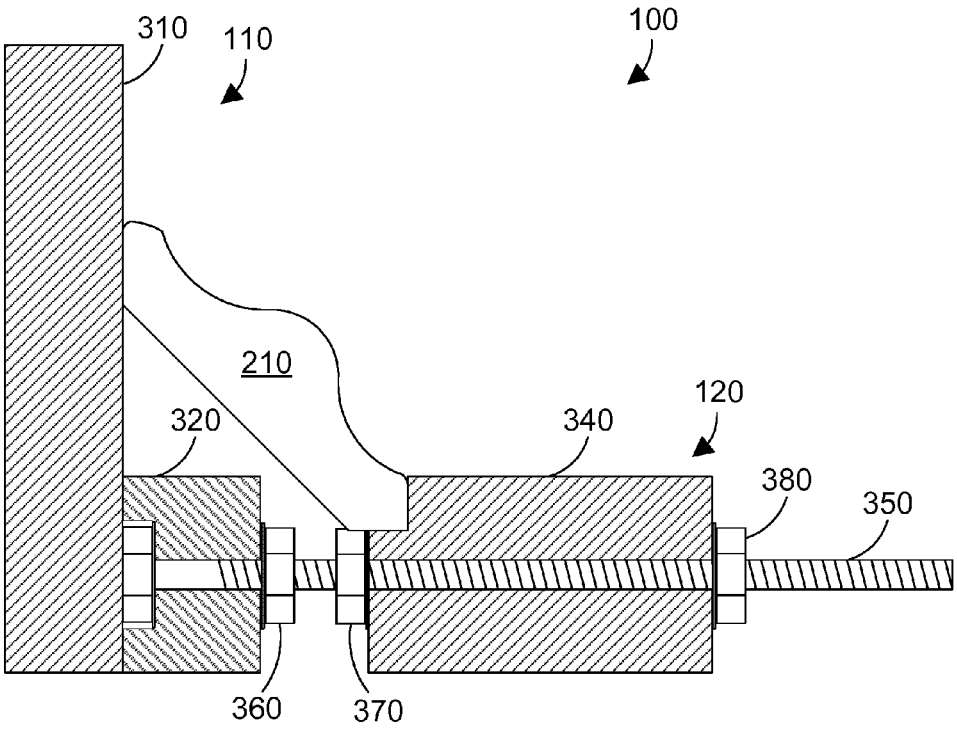
FIG. 4
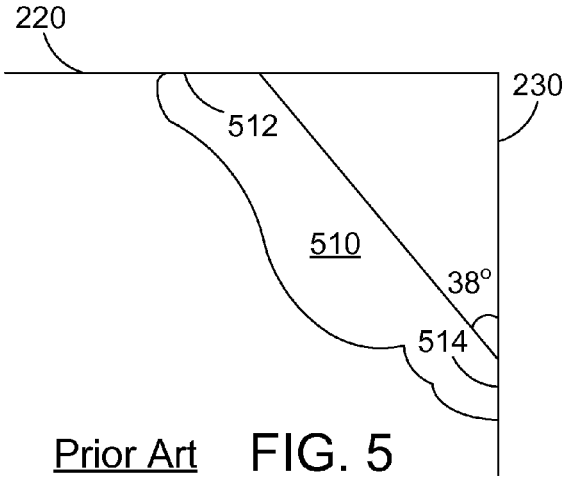
Prior Art FIG. 5

MITER BOX FENCE SYSTEM

BACKGROUND

1. Technical Field

This disclosure generally relates to woodworking tools, and more specifically relates to a fence for a miter box.

2. Background Art

Miter boxes have been used for many years by finish carpenters. A miter box allows a finish carpenter to cut angled cuts that provide attractive joints for a variety of different finishing work, such as window and door casings, baseboard, and crown molding. Cutting crown molding presents a unique challenge because crown molding is installed at an angle with respect to the wall and ceiling. As a result, cutting a traditional 45 degree angle in crown molding requires a compound miter cut, which means the saw blade is typically set at a first angle (such as 45 degrees) with respect to the miter box fence, and the blade is then tilted at an appropriate angle. Compound miter cuts create unique challenges for the finish carpenter for a variety of reasons. First, because crown moldings are made to be installed at different angles, a different compound miter cut must be used for each different angle of crown molding. For example, crown moldings that have a designed angle with respect to the wall of 38 degrees, 45 degrees, and 52 degrees are common. To make an appropriate compound miter cut, the finish carpenter must first determine the appropriate angle of the crown molding being used, then use a table that converts the angle of the crown molding to an appropriate blade tilt on the miter saw. Another challenge to cutting crown molding is the molding is laid flat and pressed against the fence, which is not representative of how it is installed. As a result, it is easy to get confused regarding which direction the cut needs to go, and whether the top or bottom of the crown molding is held against the fence.

Several devices have addressed some of the problems in cutting crown molding by providing various ways to hold crown molding at an angle while cutting, which eliminates the need for performing compound miter cuts. For example, if a 45 degree crown molding is held at a 45 degree angle instead of being held flat, a single miter cut is all that is needed instead of a compound miter cut. These devices can be classified as two separate types. The first type is a device separate from the miter saw that holds the crown molding at an angle while the saw cuts the crown molding. Examples of these are show in U.S. Pat. Nos. 6,481,320, D557,296 and D640,112. The second type is a fence system for a miter saw that provides stops on the horizontal part of the fence that allow placing crown molding between the stops and the vertical part of the fence at the appropriate angle. Examples of these are shown in U.S. Pat. Nos. 346,240, 752,406, 3,397,722, 4,875,399 and 7,726,224. Both of these types hold the crown molding at the appropriate angle while cutting, thereby eliminating one of the angles needed during the cut. This allows crown molding to be cut with a miter saw using simple miter cuts instead of using compound miter cuts.

One drawback of the second type of devices discussed above is the stops for the crown molding are placed on top of the flat surface of the fence. If the finish carpenter then needs to use the miter box for cutting flat stock such as a door casing, the device used to cut the crown molding must be removed. What is needed is a miter box fence system that allows cutting crown molding and that allows cutting flat stock without modification of the fence system.

BRIEF SUMMARY

A miter box fence system includes a vertical portion and a movable portion that may be moved with respect to the vertical portion. The movable portion includes a notch that allows one edge of crown molding to be placed in the notch while the other edge of the crown molding extends towards the vertical portion. The movable portion may be moved with the crown molding in place until the crown molding makes appropriate contact with the bottom of the notch and with the vertical portion. The movable portion may then be secured in place. Because the notch in the movable portion creates a stop for cutting crown molding, and because the notch is below the flat portion of the movable portion, the miter box fence system may be used to cut both crown molding and flat stock without modification.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

FIG. 4 is a cross-sectional side view of the miter box fence system with a piece of crown molding;

FIG. 5 is a cross-sectional diagram showing crown molding installed between a wall and a ceiling;

DETAILED DESCRIPTION

Figure 1:
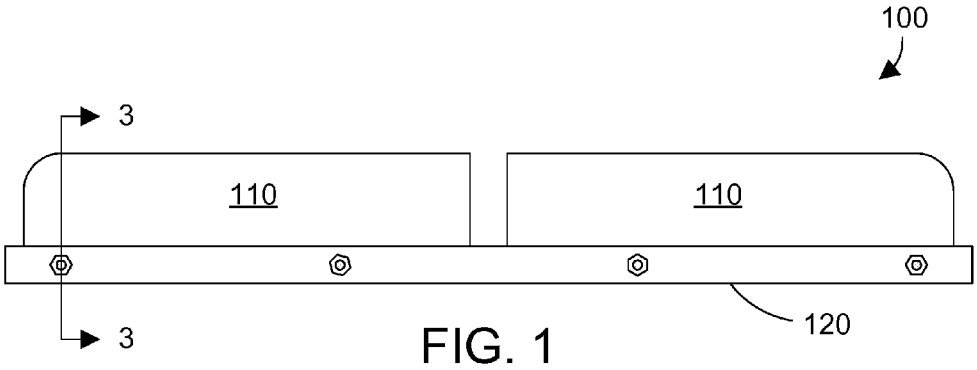
FIG. 1 is front view of a miter box fence system.

A miter box fence system 100 is shown in FIG. 1 to include a vertical portion 110 coupled to a movable portion 120. Movable portion 120 is movable or adjustable with respect to vertical portion 110 to accommodate different sizes of crown molding. In the specific configuration shown in FIG. 1, the movable portion 120 is movably coupled to the vertical portion 110 using four bolts and using corresponding nuts. One of the four bolts with its corresponding nuts are shown in the cross-sectional side view shown in FIG. 3.

Figure 2:
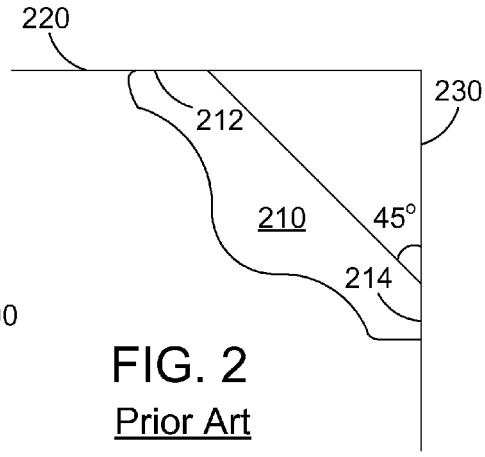
FIG. 2 Prior Art
FIG. 2 is a cross-sectional diagram showing crown molding installed between a wall and a ceiling.

FIG. 2 shows a typical installation of crown molding 210 between a ceiling 220 and a wall 230. The crown molding includes a first flat edge 212 that is placed flat on the ceiling 220 and a second flat edge 214 that is placed flat on the wall 230, as shown in FIG. 2. The particular piece of crown molding shown in FIG. 2 has an angle of 45 degrees with respect to the wall. Common angles for crown molding include 38 degrees, 45 degrees, and 52 degrees.

Because crown molding is installed at an angle with respect to the wall and ceiling, cutting crown molding when laid flat on a miter box fence requires making a compound miter cut.

The angle of the compound miter cut will vary with the angle of the crown molding. The compound miter cut may be eliminated if the crown molding is held at the appropriate angle while being cut.

Figure 3:
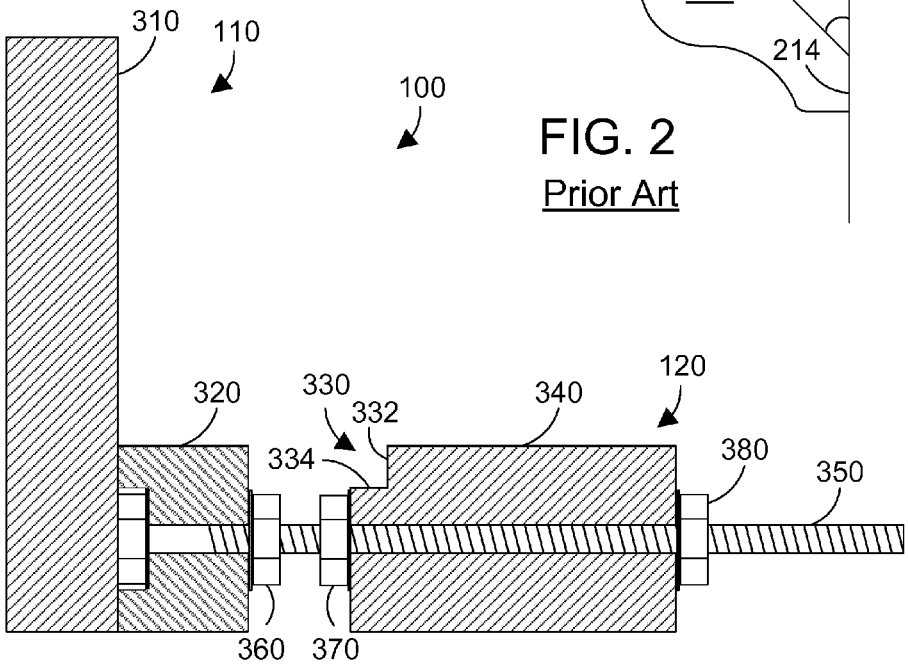
FIG. 3 is a cross-sectional side view of the miter box fence system taken along the line 3-3 in FIG. 1.

A cross-sectional view of the miter box fence system 100 in FIG. 1 taken along the line 3-3 is shown in FIG. 3. The vertical portion 110 is preferably L-shaped as shown, and includes a vertical planar surface 310 and a substantially horizontal planar surface 320. The movable portion 120 is adjustably coupled to the vertical portion 110 with a plurality of bolts 350 and a plurality of nuts 360, 370 and 380 in a configuration that allows adjusting position of the movable portion 120 with respect to the vertical portion 110. The movable portion 120 includes a first planar portion 340 that is substantially coplanar with the substantially horizontal planar surface 320 of the vertical portion 110. The movable portion 120 further comprises a notch 330 that comprises a substantially vertical surface 332 and a substantially horizontal surface 334 below the first planar portion 340. While the reference designators for the notch 330, vertical surface 332, and substantially horizontal surface 334 shown in FIG. 3 are not shown in FIGS. 4, 6, 7 and 8 due to space limitations, it is understood that the notch shown in FIGS. 4, 6, 7 and 8 is the same notch 330 with vertical surface 332 and substantially horizontal surface 334 shown in FIG. 3.

Figure 6:
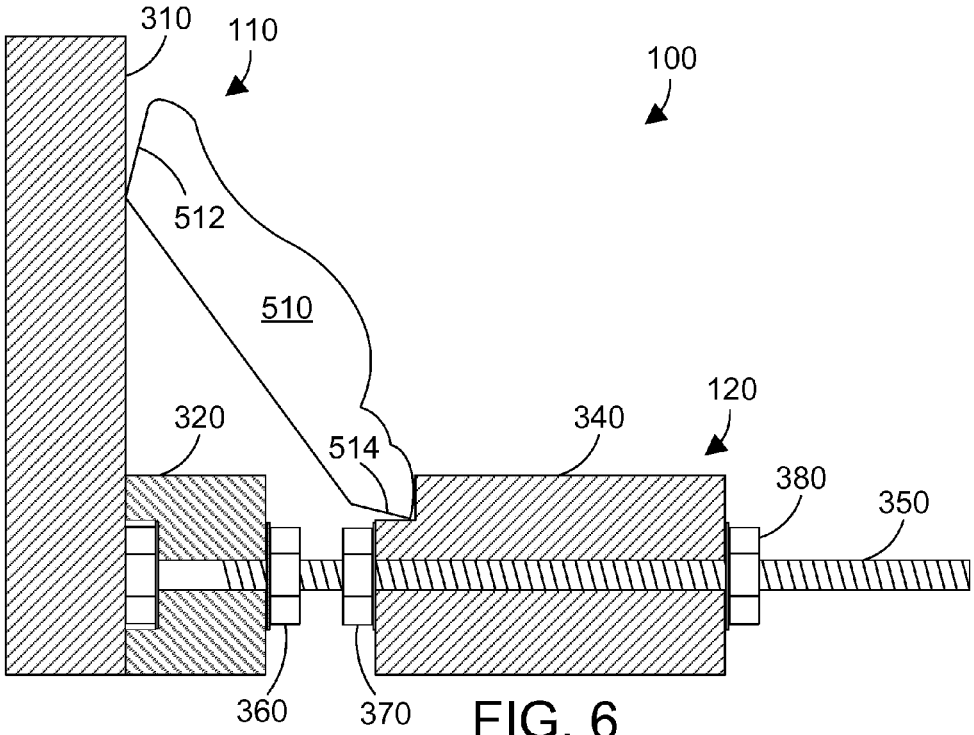
FIG. 6 is a cross-sectional side view of the miter box fence system showing placement of the crown molding in FIG. 5 into the miter box fence system, which results in an inaccurate fit.
Figure 7:
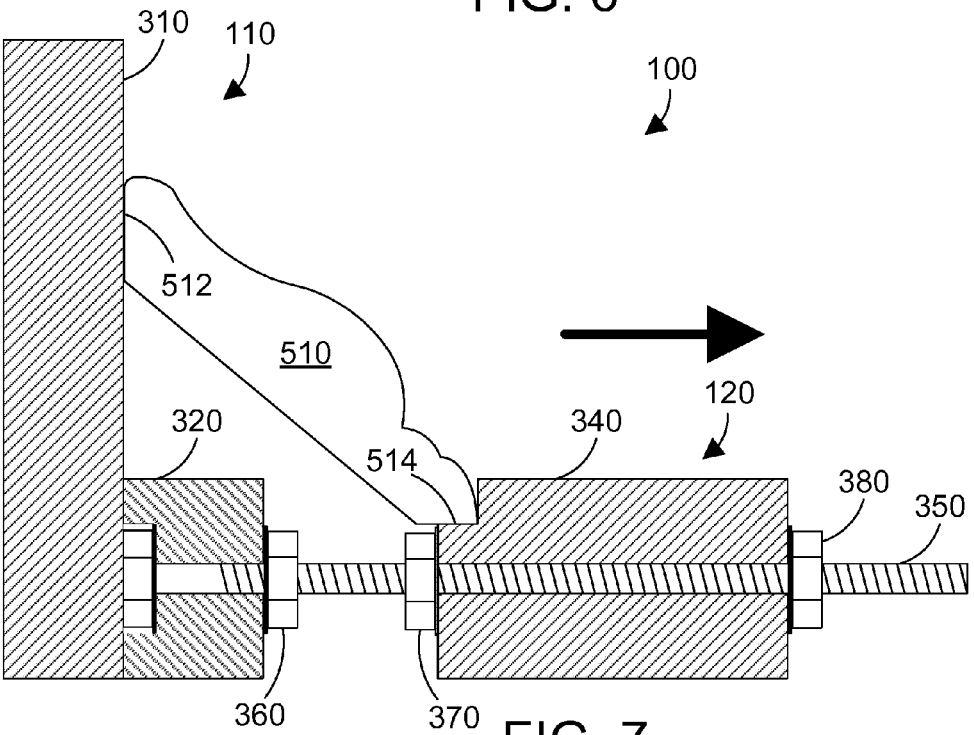
FIG. 7 is a cross-sectional side view of the miter box fence system showing adjustment of the movable portion to provide an accurate fit for the crown molding.

Crown molding may be cut using the miter box fence system 100 by placing a first edge of the crown molding into the notch 330 and by placing a second edge of the crown molding against the vertical planar surface 310, as shown in FIG. 4. This holds the crown molding at the same angle when the crown molding is installed, eliminating the need to make a compound miter cut. The miter box fence system may be adjusted to accommodate different sizes of crown molding. Referring to FIG. 5, crown molding 510 has an angle of 38 degrees with respect to wall 230 and has a width greater than the width of crown molding 210 shown in FIG. 2. With the miter box fence system adjusted as shown in FIG. 4 for the narrower crown molding 210 shown in FIGS. 2 and 4, placing the wider piece of crown molding into the slot as shown in FIG. 6 results in a poor fit, with flat surface 512 of crown molding 510 not flat against the vertical planar surface 310 and with flat surface 514 not flat against the substantially horizontal surface 334 of notch 330. This indicates to the user of the miter box fence system that the movable portion 120 needs to be moved to the right as shown by the bold arrow in FIG. 7 until the flat surface 512 is flat against the vertical planar surface 310 and the flat surface 514 is flat against the substantially horizontal surface 334 of notch 330, as shown in FIG. 7. This is accomplished by loosening nuts 370 and 380 that attach the movable portion 120 to bolt 350, and turning the nut 380 to allow the movable portion 120 to move to the position shown in FIG. 7. Once the movable portion is positioned as shown in FIG. 7, the nuts 370 and 380 are tightened to captivate the movable portion 120 in the proper position for this particular crown molding. At this point the finish carpenter can use the miter box fence system 100 to make whatever cuts are needed on the crown molding without having to make compound miter cuts.

One of the advantages to the miter box fence system 100 is the finish carpenter can visualize what cut to make based on the orientation of the crown molding. Thus, in the configuration shown in FIG. 7, if the finish carpenter visualizes the vertical planar surface 310 as the ceiling and the substantially horizontal surface 334 as the wall, the direction of the cut that is needed is easily determined visually. This reduces the errors that often result from making compound miter cuts.

Figure 8:
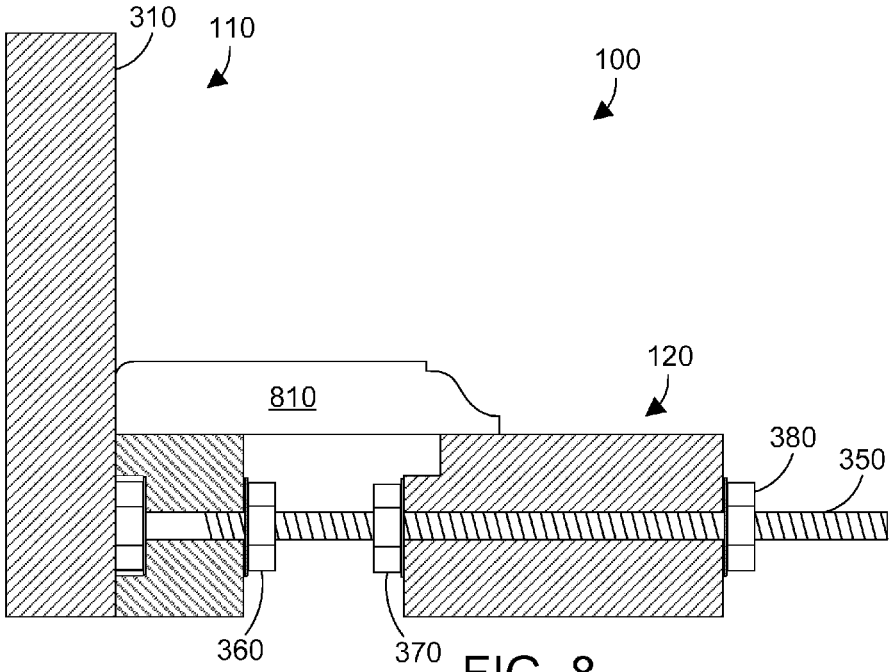
FIG. 8 is a cross-sectional side view of the miter box fence system showing cutting of flat stock such as baseboard.
Figure 9:
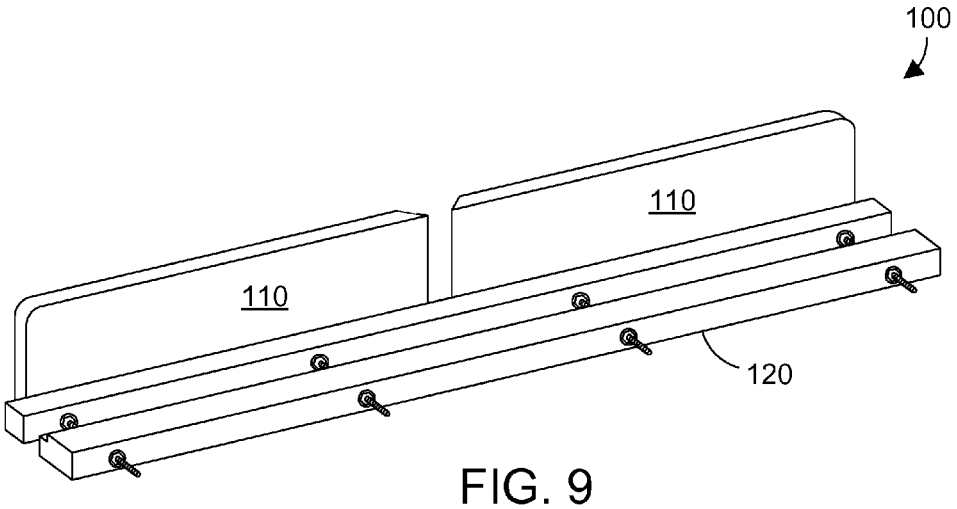
FIG. 9 is perspective view of the miter box fence system.

One significant advantage of the miter box fence system 100 is the ability to cut flat stock such as baseboard 810 without making any changes to the miter box fence system 100, as shown in FIG. 8. All known miter box fence systems that are used for crown molding do not allow cutting flat stock without modification. The baseboard 810 bridges the gap between the vertical portion 110 and the movable portion 120, resting on the coplanar surfaces so the flat stock may be cut using the miter box. FIG. 9 shows a perspective view of the miter box fence system 100.

The miter box fence system 100 may be made of any suitable material, including wood, plastic, metal, composite or synthetic materials, etc. The most preferred materials are wood and plastic, which provide the necessary rigidity while allowing a miter saw to easily cut the miter box fence system 100 that is directly under the blade.

The miter box fence system 100 may be used on motorized miter saws or on manual miter saws. The miter box fence system 100 may be attached to the miter saw in any suitable way, such as using nuts and bolts to couple the vertical portion 110 to a corresponding vertical fence on the miter saw. This could be done, by way of example, using flathead screws that extend through the vertical portion then through corresponding holes in the vertical fence on the miter saw, thus recessing the flat heads below the vertical planar surface 310 so the screws do not interfere with use of the miter box fence system. Of course, wing nuts could replace the hex nuts shown in the figures to make it easier to adjust the movable portion by hand without using tools.

Various fasteners could also be used to movably couple the movable portion 120 to the vertical portion 110. Nuts and bolts are shown as one example, and any suitable fastener could be used for coupling the movable portion 120 to the vertical portion 110 in a way that the movable portion may be moved or adjusted, then fixed in the adjusted position. For example, the internal portion of movable portion 120 could be threaded. In this configuration, access to the head of the bolt from the back side of the vertical portion would allow a user to turn the head of the bolt to move the movable portion. Another possible configuration is to use smooth rods instead of bolts, with friction push nuts that have a release mechanism. In addition, the number of fasteners could vary. Thus, while the figures show four bolts, any suitable number of fasteners could be used. In addition, a more complex design is clearly within the scope of the disclosure and claims herein. For example, the movable portion 120 could be movably coupled to the vertical portion 110 using a track and rail system, similar to a drawer sliding on drawer guides, with a locking mechanism to lock the movable portion 120 in a desired position. The disclosure and claims herein expressly extend to any suitable fastener, number of fasteners, and mechanisms that can couple movable portion 120 to vertical portion 110 in a way that is adjustable, yet allows fixing the movable portion 120 in a desired position.

Figure 10:
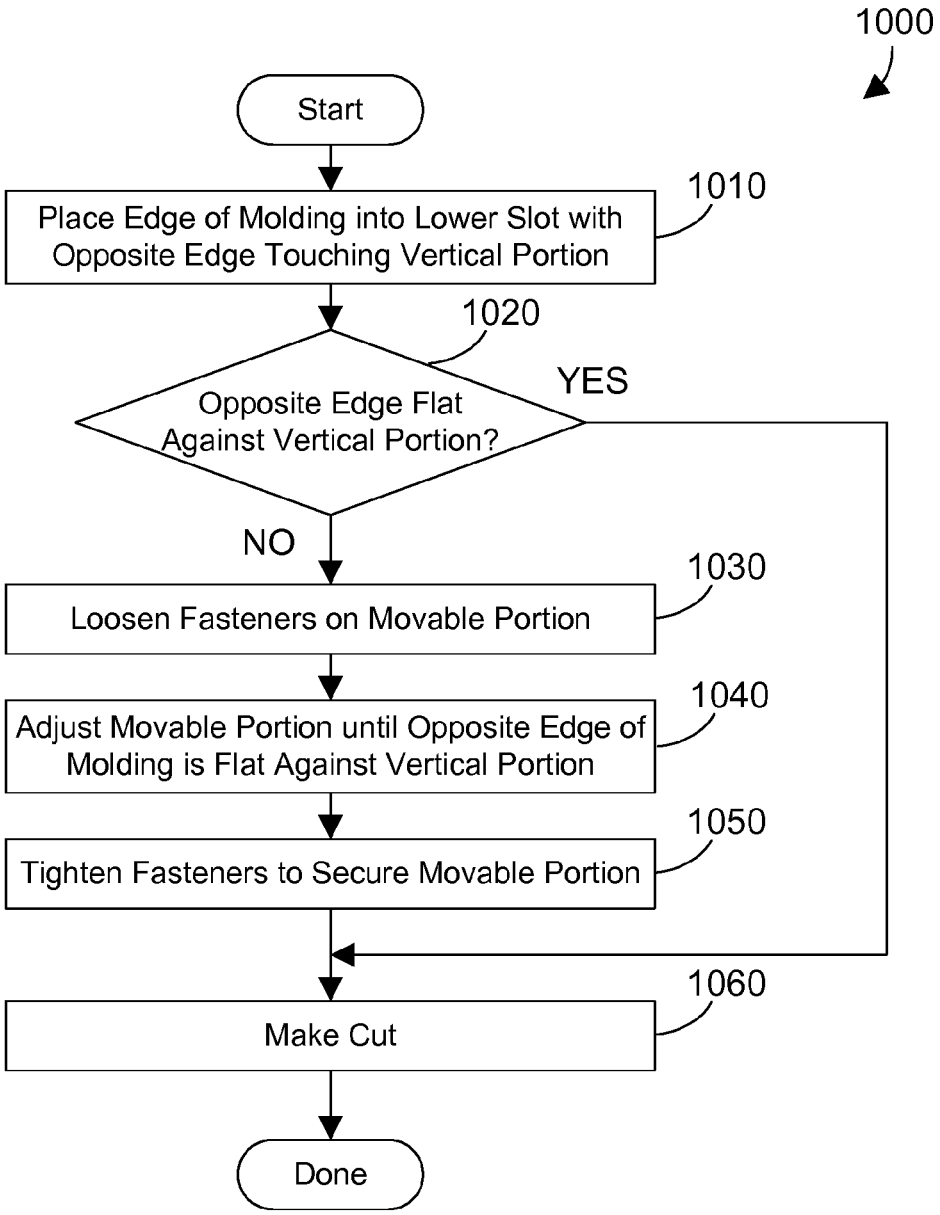
FIG. 10 is a method for using the miter box fence system to cut crown molding.

FIG. 10 shows a method 1000 for using the miter box fence system to cut crown molding. One edge of the crown molding is placed into the lower slot of the movable portion, with the opposite edge touching the vertical portion (step 1010). When the opposite edge is flat against the vertical portion (step 1020=YES), such as shown in FIGS. 4 and 7, the cut may be made with the miter box (step 1060). When the opposite edge is not flat against the vertical portion (step 1020=NO), such as shown in FIG. 6, the fasteners on the movable portion are loosened (step 1030), and the movable portion is adjusted or moved until the opposite edge of the crown molding is flat against the vertical portion (step 1040). Note that once the opposite edge of the crown molding is flat against the vertical portion, the edge in the slot will also be flat against the substantially horizontal surface of the slot. Once the movable portion is in the proper position, the fasteners are tightened to secure the movable portion in the desired position with respect to the vertical portion (step 1050). The cut is then made (step 1060).

The miter box fence system provides an easy way to cut crown molding using a single miter cut instead of a compound miter cut. The finish carpenter can easily visualize what cut needs to be made because of the orientation of the crown molding. In addition, flat stock may be cut without any changes to the miter box fence system.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. A miter box fence system comprising:

a vertical portion in a fixed position with respect to a miter box that cuts a miter joint, the vertical portion comprising:

a top portion that faces up;

a first vertical planar surface having a first end that connects along its length to the top portion and that extends in a downward direction opposite the top portion and having a second end substantially parallel to and opposite the first end;

a substantially horizontal planar surface that faces up and extends from the second end of the first vertical planar surface; and a second vertical planar surface extending down from the horizontal planar surface;

a movable portion adjustably coupled to the vertical portion, the movable portion including a first planar portion that faces up and is substantially coplanar with the substantially horizontal planar surface of the vertical portion and a notch that comprises a substantially vertical surface that is parallel to the second vertical planar surface and extends down from the first planar portion and a substantially horizontal planar surface facing up and extending horizontally from the substantially vertical surface of the notch below the first planar portion.

2. The miter box fence system of claim 1 wherein flat stock is cut using the miter box fence system by placing the flat stock atop the substantially horizontal planar surface of the vertical portion and the first planar portion of the movable portion.

3. The miter box fence system of claim 1 wherein the movable portion is secured to the vertical portion using a plurality of bolts and a plurality of nuts in a configuration that allows adjusting position of the movable portion with respect to the vertical portion.

4. The miter box fence system of claim 1 wherein the miter box fence system is adjustable to cut a piece of crown molding by placing a first side of the piece into the notch and placing a second side of the piece against the first vertical planar surface of the vertical portion, and by adjusting the movable portion to a position where a first flat edge portion on the first side of the piece rests substantially flat against the substantially horizontal planar surface of the notch and a second flat edge portion on the second side of the piece rests substantially flat against the first vertical planar surface of the vertical portion.

5. The miter box fence system of claim 1 wherein the vertical portion and the movable portion are made of wood.

6. The miter box fence system of claim 1 wherein the vertical portion and the movable portion are made of plastic.

7. The miter box fence system of claim 1 wherein crown molding is cut using the miter box fence system by placing a first edge of the crown molding into the notch and by placing a second edge of the crown molding against the vertical planar surface.

8. A miter box fence system comprising:

an L-shaped vertical portion in a fixed position with respect to a miter box that cuts a miter joint, the L-shaped vertical portion comprising:

a top portion that faces up;

a first vertical planar surface having a first end that connects along its length to the top portion and that extends in a downward direction opposite the top portion and having a second end substantially parallel to and opposite the first end;

a substantially horizontal planar surface that faces up and extends from the second end of the first vertical planar surface; and a second vertical planar surface extending down from the horizontal planar surface;

a movable portion adjustably coupled to the L-shaped vertical portion with a plurality of bolts and a plurality of nuts in a configuration that allows adjusting position of the movable portion with respect to the L-shaped vertical portion, the movable portion including a first planar portion that faces up that is substantially coplanar with the substantially horizontal planar surface of the L-shaped vertical portion, the movable portion further comprising a notch that comprises a substantially vertical surface that is parallel to the second vertical planar surface and extends down from the first planar portion and a substantially horizontal planar surface facing up and extending horizontally from the substantially vertical surface of the notch below the first planar portion, wherein crown molding is cut using the miter box fence system by placing a first edge of the crown molding into the notch and by placing a second edge of the crown molding against the first vertical planar surface, wherein flat stock is cut using the miter box fence system by placing the flat stock against the first vertical planar surface and atop the substantially horizontal planar surface of the L-shaped vertical portion and the first planar portion of the movable portion, wherein the miter box fence system is adjustable to cut a piece of crown molding by placing a first side of the piece into the notch and placing the second side of the piece against the vertical planar surface of the L-shaped vertical portion, and by adjusting the movable portion to a position where a first flat edge portion on the first side of the piece rests substantially flat against the substantially horizontal planar surface of the notch and a second flat edge portion on the second side of the piece rests substantially flat against the first vertical planar surface of the L-shaped vertical portion.

9. The miter box fence system of claim 8 wherein the L-shaped vertical portion and the movable portion are made of wood.

10. The miter box fence system of claim 8 wherein the L-shaped vertical portion and the movable portion are made of plastic.

11. A method for cutting comprising the steps of:

attaching a miter box fence system to a miter box, the miter box fence system comprising:

a vertical portion in a fixed position with respect to the miter box, the vertical portion comprising:

a top portion that faces up;

a first vertical planar surface having a first end that connects along its length to the top portion and that extends in a downward direction opposite the top portion and having a second end substantially parallel to and opposite the first end;

a substantially horizontal planar surface that faces up and extends from the second end of the first vertical planar surface; and a second vertical planar surface extending down from the horizontal planar surface;

a movable portion adjustably coupled to the vertical portion, the movable portion including a first planar portion that faces up and is substantially coplanar with the substantially horizontal planar surface of the vertical portion and a notch that comprises a substantially vertical surface that is parallel to the second vertical planar surface and extends down from the first planar portion and a substantially horizontal planar surface facing up and extending horizontally from the substantially vertical surface of the notch below the first planar portion;

placing a first side of a piece of crown molding into the notch and placing the second side of the piece of crown molding against the first vertical planar surface of the vertical portion;

adjusting the movable portion to an adjusted position where a first flat edge portion on the first side of the piece rests substantially flat against the substantially horizontal planar surface of the notch and a second flat edge portion on the second side of the piece rests substantially flat against the first vertical planar surface of the vertical portion;

fixing the movable portion in the adjusted position;

aligning the crown molding with a saw blade; and cutting the crown molding using the saw blade.

12. The method of claim 11 further comprising the step of cutting flat stock using the miter box fence system by placing an edge of the flat stock against the vertical portion and by placing a flat portion of the flat stock on the substantially horizontal planar surface of the vertical portion and on the substantially horizontal planar surface of the first planar portion of the movable portion.

* * * * *